US005996697A

United States Patent [19]

Vick et al.

[11] Patent Number: 5,996,697

[45] Date of Patent: Dec. 7, 1999

[54] STATIC WELLHEAD PLUG

[75] Inventors: James D. Vick, Dallas; Rennie L. Dickson; William R. Welch, both of Carrollton; Jayson A. Byrd, Arlington, all of Tex.

[73] Assignee: Halliburton Energy Services, Inc., Dallas, Tex.

[21] Appl. No.: 09/124,700

[22] Filed: Jul. 29, 1998

Related U.S. Application Data

[62] Division of application No. 08/753,194, Nov. 21, 1996, Pat. No. 5,875,851.

[51] Int. Cl.[6] ..... E21B 33/035

[52] U.S. Cl. ..... 166/386; 166/75.13; 166/135; 166/88.1; 166/368; 166/115

[58] Field of Search ..... 166/386, 75.13, 166/135, 88.1, 89.3, 95.1, 368, 115

[56] References Cited

U.S. PATENT DOCUMENTS

| | | | |
|---|---|---|---|
| 3,602,303 | 8/1971 | Blenkarn | 166/360 |
| 5,318,117 | 6/1994 | Echols et al. | 166/128 X |
| 5,398,764 | 3/1995 | Collins | 166/212 X |
| 5,509,476 | 4/1996 | Vick, Jr. | 166/75.13 |
| 5,542,475 | 8/1996 | Turner et al. | 166/387 |
| 5,555,935 | 9/1996 | Brammer et al. | 166/88.1 |

*Primary Examiner*—Roger Schoeppel
*Attorney, Agent, or Firm*—William M. Imwalle; Marlin R. Smith

[57] ABSTRACT

A plug is provided which is specially adapted for statically setting a plug portion within an internal profile formed in a wellhead. In an illustrated preferred embodiment, the plug portion is set by application of fluid pressure to a running tool portion. When set in the profile, the plug portion is secured statically relative to the profile, thereby permitting advantageous utilization of a metal-to-metal seal on the plug portion. The plug portion includes features which maintain its set configuration in the profile. The running tool portion includes multiple pistons which enhance operation of the running tool portion. A disclosed verification tool provides an indication that the plug portion has been properly set.

20 Claims, 12 Drawing Sheets

FIG.5
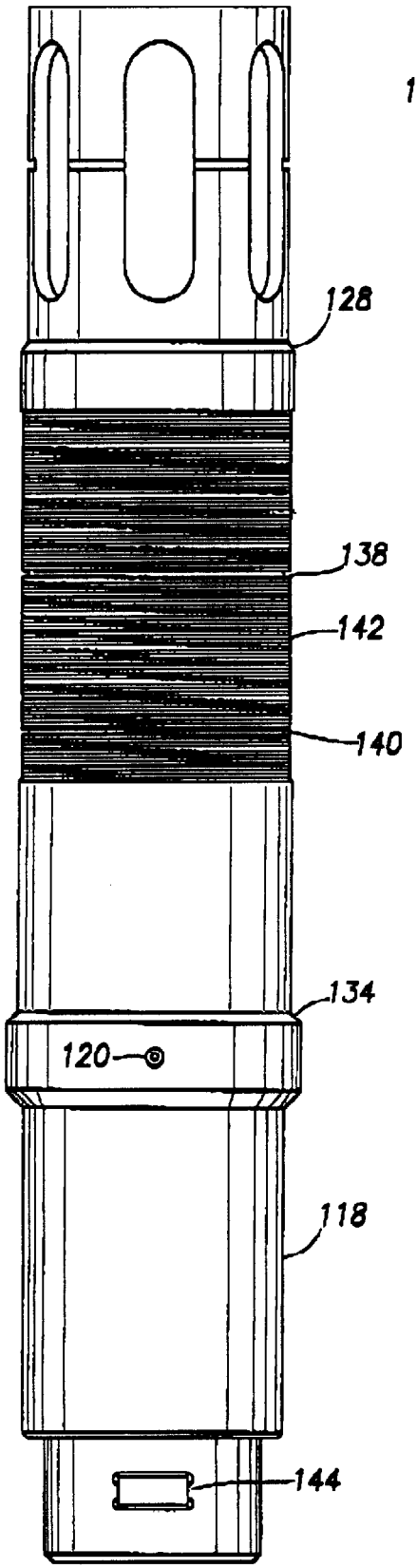
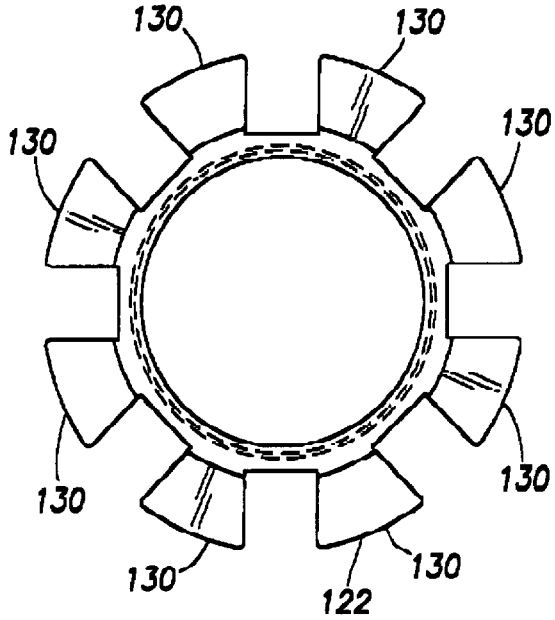
FIG.4
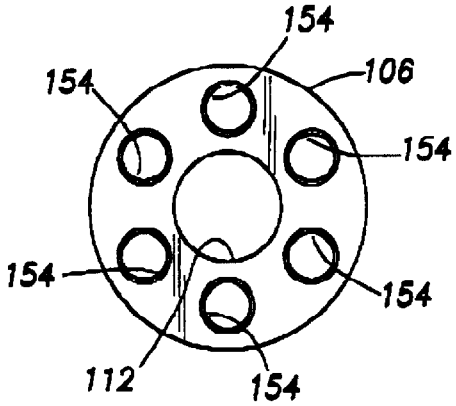
FIG.6

STATIC WELLHEAD PLUG

This is a division of application Ser. No. 08/753,194, filed Nov. 21, 1996, (now U.S. Pat. No. 5,875,851) such prior application being incorporated by reference herein in its entirety.

BACKGROUND OF THE INVENTION

The present invention relates generally to operations wherein wellheads are installed on subterranean wells and, in a preferred embodiment thereof, more particularly provides a wellhead plug and associated methods of plugging wellheads.

With the advent of horizontal tree designs for use in offshore well completions, the safety, convenience, and economics of wellhead installations have been greatly improved. These enhancements are detailed in a paper (OTC 7917) presented at the 27th Annual Offshore Technology Conference in 1995. That paper is incorporated herein by this reference.

A major benefit derived from the use of a horizontal tree is that a wireline-retrievable plug may be used in a vertical portion of the wellhead above the horizontally-oriented production flow passage. The plug may be removed from the wellhead after the well has been placed in production, for example, in order to provide access to the well for workover operations. Typically, the plug is set in a profile formed internally on a tubing hanger installed in the wellhead before the well was placed in production.

In some circumstances, a second plug may be installed above the plug set in the tree. The upper plug is typically set in a high pressure cap installed on top of the wellhead.

Since the cost of the wellhead is related to its vertical length, it may be easily seen that it is desirable for the wellhead plugs to be made as short as possible, while maintaining their ability to withstand fluid pressure applied from above or below. Costs are also associated with installation and retrieval of the plugs, and the most economical installations and retrievals are typically performed by wireline or slickline.

In many instances, a well may be in production for many years before the need arises to perform workover operations, or to otherwise gain physical access to the wellbore. Thus, a wellhead plug may be called on to maintain its sealing capability for many years as well. For this reason and others, it is desirable for the plug to be fitted with metal-to-metal (MTM) seals, which are exceptionally long-lasting and resistant to long term temperature degradation. Unfortunately, the use of MTM seals typically requires highly polished seal surfaces, application of special coatings and/or metal alloys to seal surfaces, very close machining tolerances, and/or other special operations, which make it rather expensive to utilize MTM seals.

In any event, when MTM seals are utilized it is important to prevent relative movement between surfaces contacted by the MTM seals. This is because both the seals and surfaces are made of metal and will become damaged if there is relative movement between them while they are in contact and under pressure. If such damage occurs, the MTM seals will no longer function properly. Therefore, in operation, when MTM seals are utilized on wellhead plugs, it is desirable for the plugs to be "static", that is, motionless relative to the wellhead in which the plugs are installed.

Additionally, it is desirable for wellhead plugs to be maintained in their set positions for long periods of time, since, as set forth above, many years may elapse before they are removed to provide access to the wellbore. Various schemes have been developed for maintaining a wellhead plug in its set position, while still permitting convenient unsetting by wireline operations. For example, some plugs rely on gravity and friction between an expander sleeve and keys to maintain the plugs in their set position. These, however, have been less than satisfactory because vibration and stress cycles tend to dislocate the expander sleeve over time.

It is also desirable for a wellhead plug to provide multiple locations to aid in fishing operations when the plug cannot be retrieved by normal wireline operations as designed. Again, this is of particular importance in wellhead plugs, since they may be retrieved after many years of service, and since they control physical access to the well.

And finally, typical wellhead plugs utilize a downward jarring force to displace the expander sleeve and thereby force the keys outward into the profile in the tubing hanger or high pressure cap. This jarring force is difficult to control accurately and may result in improperly set plugs, damaged plugs, and/or misruns, etc. It would be much more desirable to provide a wellhead plug which is settable by application of fluid pressure. Such methods of setting wellhead plugs would be of particular value where MTM seals are utilized with the plugs.

From the foregoing, it can be seen that it would be quite desirable to provide a wellhead plug capable of utilizing MTM seals, which is static in operation, which is wireline-conveyable and wireline-retrievable, which is settable by application of fluid pressure, which includes features which reliably maintain the plug in its set position, which is relatively short in length and small in diameter, and which provides multiple locations for fishing operations. It is accordingly an object of the present invention to provide such a wellhead plug and associated methods of plugging wellheads.

SUMMARY OF THE INVENTION

In carrying out the principles of the present invention, in accordance with an embodiment thereof, a plug is provided which utilizes a metal-to-metal seal to seal off a flow passage within a wellhead. The plug includes a plug portion which is statically settable with a profile positioned within the wellhead. The plug also includes a running tool portion which is responsive to fluid pressure within the wellhead to set the plug portion.

In broad terms, apparatus is provided for installation in an internal profile formed proximate a subterranean well. The profile has an at least partially downwardly facing surface and an at least partially upwardly facing shoulder, and the profile surface and shoulder are axially spaced apart from each other. The apparatus includes a housing, a profile engagement member, and an expander member.

The housing is axially elongated and is positionable within the profile. The profile engagement member has first and second surfaces formed thereon, and is disposed proximate the housing. The profile engagement member is configured for radially outward extension relative to the housing. The first surface is capable of operatively engaging the profile surface when the profile engagement member is radially outwardly extended relative to the housing.

The expander member has an external surface formed thereon, and is disposed at least partially within the housing. It is positionable in a selected one of first and second positions relative to the engagement member. The engagement member is radially inwardly retracted out of engagement with the profile surface when the expander member is in the first position. The expander member external surface contacts the engagement member second surface such that the engagement member first surface radially outwardly engages the profile surface when the expander member is in the second position.

A method of setting a plug within an internally formed profile is also provided by the present invention. The method includes the steps of providing the plug having a housing, an engagement member, and an expander member, each of the engagement member and expander member being disposed at least partially within the housing, the expander member being capable of being displaced from a first position to a second position relative to the housing, such that the expander member radially outwardly displaces the engagement member into engagement with the profile to thereby statically position the housing within the profile when the expander member is in the second position; providing a running tool capable of displacing the expander member from the first position to the second position in response to fluid pressure applied to the running tool; positioning the expander member in the first position; operatively attaching the running tool to the plug; disposing the housing within the profile; and applying fluid pressure to the running tool to thereby displace the expander member from the first position to the second position.

A running tool for conveying and setting a plug within a generally tubular member is provided by the present invention, for use with a plug which includes first and second members. The plug is settable by applying an axially directed force to the first member, applying an oppositely directed force to the second member, and displacing the first member a predetermined axial distance relative to the second member.

The running tool includes first and second portions which are axially slidably disposed relative to each other. The first portion includes a first engagement structure. The first engagement structure is capable of releasably engaging the first member.

The second portion includes a second engagement structure which is capable of releasably engaging the second member. The second portion also includes a first surface formed thereon, the first surface being capable of contacting the first engagement structure to dispose the first engagement structure in engagement with the first member when the second portion is in a first axial position with respect to the first portion. The first surface is capable of permitting the first engagement structure to disengage from the first member when the second portion is in a second axial position with respect to the first portion.

A plug for setting within a generally axially extending internal profile is provided as well. The profile has a radially reduced nogo portion and a radially enlarged portion. The plug includes a housing, a circumferential seal, an expander sleeve, and a key.

The housing has an external shoulder formed thereon, a radially extending opening formed through a sidewall portion thereof, and opposite ends. The shoulder engages the nogo portion to axially position the housing within the profile. The circumferential seal is externally disposed about the housing and sealingly engages the profile when the housing is operatively disposed within the profile.

The expander sleeve is axially slidably received at least partially within the housing. It has an external surface formed thereon. The key is radially slidably disposed relative to the housing and is radially outwardly disposed relative to the expander sleeve. The expander sleeve radially outwardly extends a portion of the key through the opening and into engagement with the profile radially enlarged portion when the expander sleeve is axially positioned relative to the housing so that the external surface is radially opposite the key.

Apparatus and methods for verifying relative axial displacement between structural elements of a plug portion are also provided by the present invention. When the plug portion is properly disposed within an internal profile associated with a subterranean well, the structural elements have a desired preselected axial displacement therebetween. The apparatus includes a mandrel capable of axially contacting one of the structural elements, and a sleeve slidingly disposed relative to the mandrel and capable of axially contacting another one of the structural elements. The sleeve is releasably secured against axially sliding displacement relative to the mandrel.

The use of the disclosed plug and associated methods permits convenient, economical, and safe plugging of a wellhead, or other portion of a subterranean well. The plug is advantageously static when set in the profile, thereby preventing undesirable displacement thereof and permitting convenient use of metal-to-metal seals thereon. The methods utilize fluid pressure to set the plug, thereby eliminating the necessity of applying a jarring force to the plug while it is being set.

BRIEF DESCRIPTION OF THE DRAWINGS

FIG. 4 is a top view of a centralizer of the first running tool portion of FIG. 3;

FIG. 5 is a side elevational view of an outer housing of the first running tool portion of FIG. 3;

FIG. 6 is a top view of a piston housing of the first running tool portion of FIG. 3;

DETAILED DESCRIPTION

Illustrated in FIGS. 1–8 is a wellhead plug 10 which embodies principles of the present invention. Although the wellhead plug 10 is representatively illustrated as being operatively installed in a wellhead 12, it is to be understood that the plug may also be utilized in other portions of wells, without departing from the principles of the present invention. Additionally, in the following description of the plug 10 (and another plug 168 described hereinbelow) representatively illustrated in the accompanying figures, directional terms, such as "upward", "downward", "upper", "lower", etc., are used in relation to the plug as depicted in the figures and are not to be construed as limiting the application, utility, manner of operation, structure, etc. of the plug.

Figure 1:
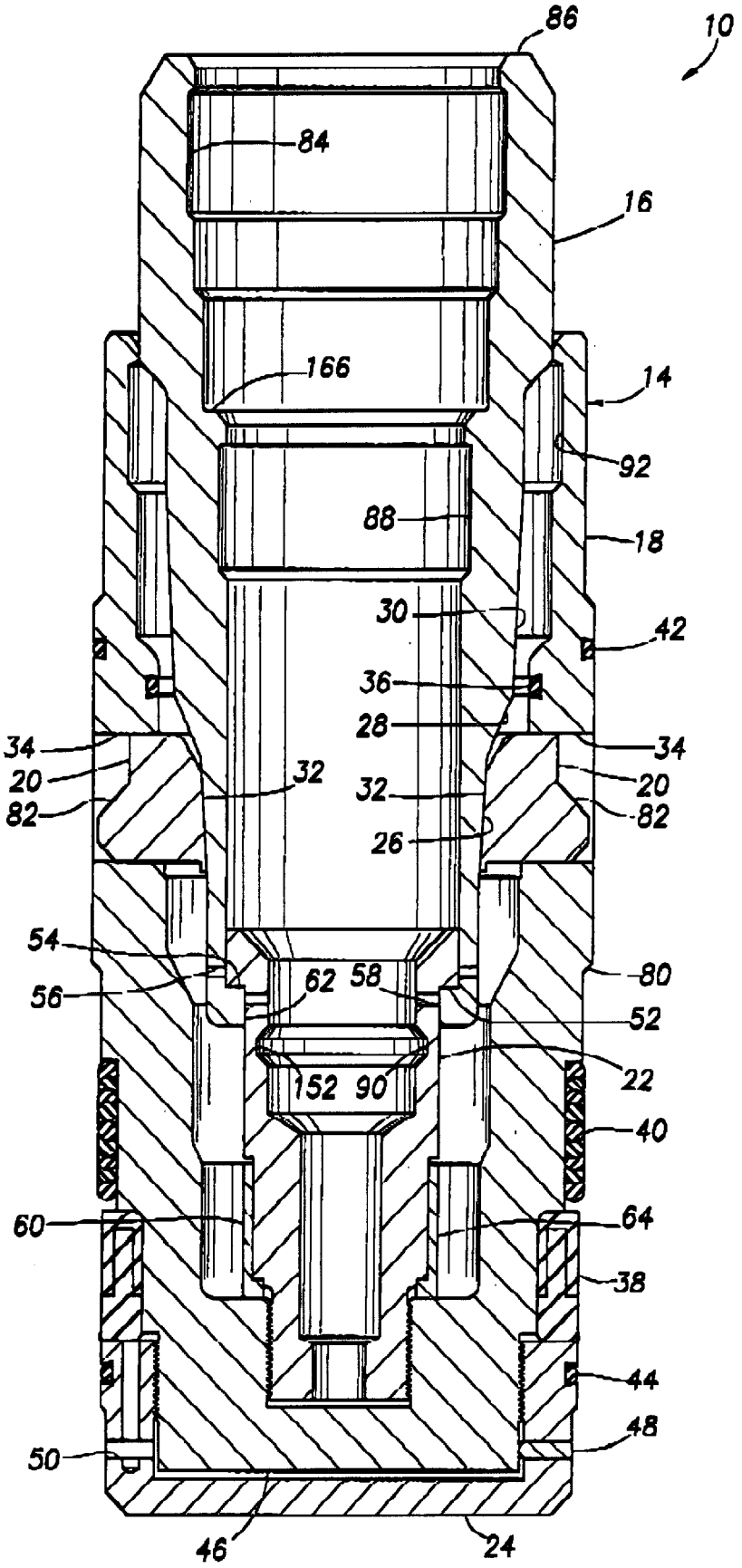
FIG. 1 is a cross-sectional view of a plug portion of a wellhead plug embodying principles of the present invention, the plug portion being shown in a configuration in which it is run into a wellhead.

As shown in FIG. 1, the plug 10 includes a plug portion 14 configured for operative installation in the wellhead 12. The plug portion 14 includes an expander sleeve 16, an outer housing 18, a series of circumferentially spaced apart keys 20 (only two of which are visible in FIG. 1), an inner sleeve 22, and an end cap or "target" 24. Configured as shown in FIG. 1, the keys 20 are radially inwardly retracted within the housing 18, so that the plug portion 14 may be conveniently transported by wireline or other conveyance from the earth's surface to the wellhead 12.

As will be more fully described hereinbelow, when it is desired to set the plug portion 14 within the wellhead 12, the expander sleeve 16 is axially downwardly displaced, thereby forcing the keys 20 radially outward into engagement with the wellhead 12. For this purpose, the generally tubular expander sleeve 16 is provided with an axial succession of radially sloping outer surfaces 26, 28, 30 formed thereon. With the keys 20 disposed radially opposite the surface 26, the keys are permitted to be radially inwardly retracted.

Note that surface 26 and a radially inwardly facing surface 32 formed on each of the keys 20 are complementarily sloped. Preferably, the surfaces 26 and 32 are angled approximately three degrees from vertical as shown in FIG. 1. Surface 26 is similarly sloped relative to surface 32 so that the keys 20 may conformingly contact the expander sleeve 16 when they are retracted.

Each of the keys 20 is slidingly disposed within an opening 34 formed radially through the outer housing 18. In this way, the keys 20 are constrained to displace radially outward when the expander sleeve 16 is displaced vertically downward, surfaces 26, 28, and 30 contacting surfaces 32 in succession. A circumferential wiper ring 36 (preferably, an oring) is internally disposed on the outer housing 18 above the keys 20 and serves to wipe debris from surface 30 when the expander sleeve 16 is downwardly displaced relative to the outer housing.

A crush-type MTM seal 38 and a packing stack 40 are circumferentially and externally disposed on the outer housing 18 between the openings 34 and the target 24. Additionally, wiper rings 42 and 44 (preferably, orings) are circumferentially and externally disposed on the outer housing 18 and target 24, respectively. The MTM seal 38 provides primary sealing engagement between the plug portion 14 and the wellhead 12, while the packing 40 serves as a backup or secondary seal therebetween. The lower wiper 44 wipes debris from the wellhead 12 prior to the MTM seal 38 entering its seal bore, and the upper wiper 42 and wiper ring 36 help prevent debris from accumulating about the keys 20 from above the plug portion 14.

The MTM seal 38 and packing 40 are of the types well known in the art. However, it is to be understood that other types of seals may be utilized without departing from the principles of the present invention, for example, elastomeric orings may be utilized in place of the MTM seal 38 and/or packing 40. Additionally, it is not necessary for there to be a secondary seal 40 according to the principles of the present invention. The illustrated seal arrangement is the one preferred by the applicants, because it has demonstrated exceptional functionality and reliability in tests and in practice.

The target 24 is threadedly installed onto the outer housing 18 at a lower end 46 thereof. A set screw 48 secures the target 24 against rotational displacement relative to the housing 18. A cross-drilled fluid passage 50 formed in the target 24 prevents entrapment of fluid pressure between the wiper 44 and the MTM seal 38.

The target 24 representatively illustrated in FIG. 1 has a minimal vertical length beyond the lower end 46 of the housing 18. In one variation of the plug portion 14, however, the target 24 may be axially extended to provide a sacrificial wear surface. The desirability of extending the target 24 may be readily appreciated by one of ordinary skill in the art, considering that when the plug portion 14 is operatively installed in the wellhead 12 and the well is placed in production, upwardly directed flow through the production tubing will impinge upon the target as the fluid changes direction before exiting the wellhead 12 via the horizontally directed production flow passage.

The generally tubular inner sleeve 22 is threadedly attached to the outer housing 18 internally and near its lower end 46. A radially outwardly extending shoulder 52 formed on the inner sleeve 22 prevents vertically upward displacement of the expander sleeve 16 as viewed in FIG. 1, since the shoulder 52 will contact a radially inwardly extending shoulder 54 formed on the expander sleeve if the expander sleeve is upwardly displaced. Two ports 56, 58 formed radially through each of the expander sleeve 16 and inner sleeve 22, respectively, provide fluid communication between the shoulders 52, 54 when the expander sleeve is displaced upwardly.

A generally tubular retainer ring 60 is externally disposed on the inner sleeve 22. The retainer ring 60 is captured at its lower end between the inner sleeve 22 and the outer housing 18 when the inner sleeve is threaded into the outer housing. As will be more fully described hereinbelow, the retainer ring 60 assists in maintaining the expander sleeve 16 in its axially downwardly disposed position when the plug portion 14 is set in the wellhead 12, due to a diametrical interference fit between an internal diameter 62 formed on the expander sleeve 16 and an external diameter 64 formed on the retainer ring 60 (diameter 64 being slightly larger than diameter 62).

Applicants prefer that the diametrical interference between diameters 62, 64 be approximately 0.002 inch so that a force of approximately 1,000 pounds is required to force the internal diameter 62 onto the external diameter 64. Additionally, applicants prefer that the retainer ring 60 be externally coated with a sputtered gold coating over a nickel base to prevent galling between the diameters 62, 64. Of course, methods of modifying the friction produced by such interference fit which are known to those skilled in the art, such as by providing serrations or knurling on one or both of diameters 62, 64, applying surface coatings to one or both of the diameters, etc., may be utilized without departing from the principles of the present invention.

Figure 2:
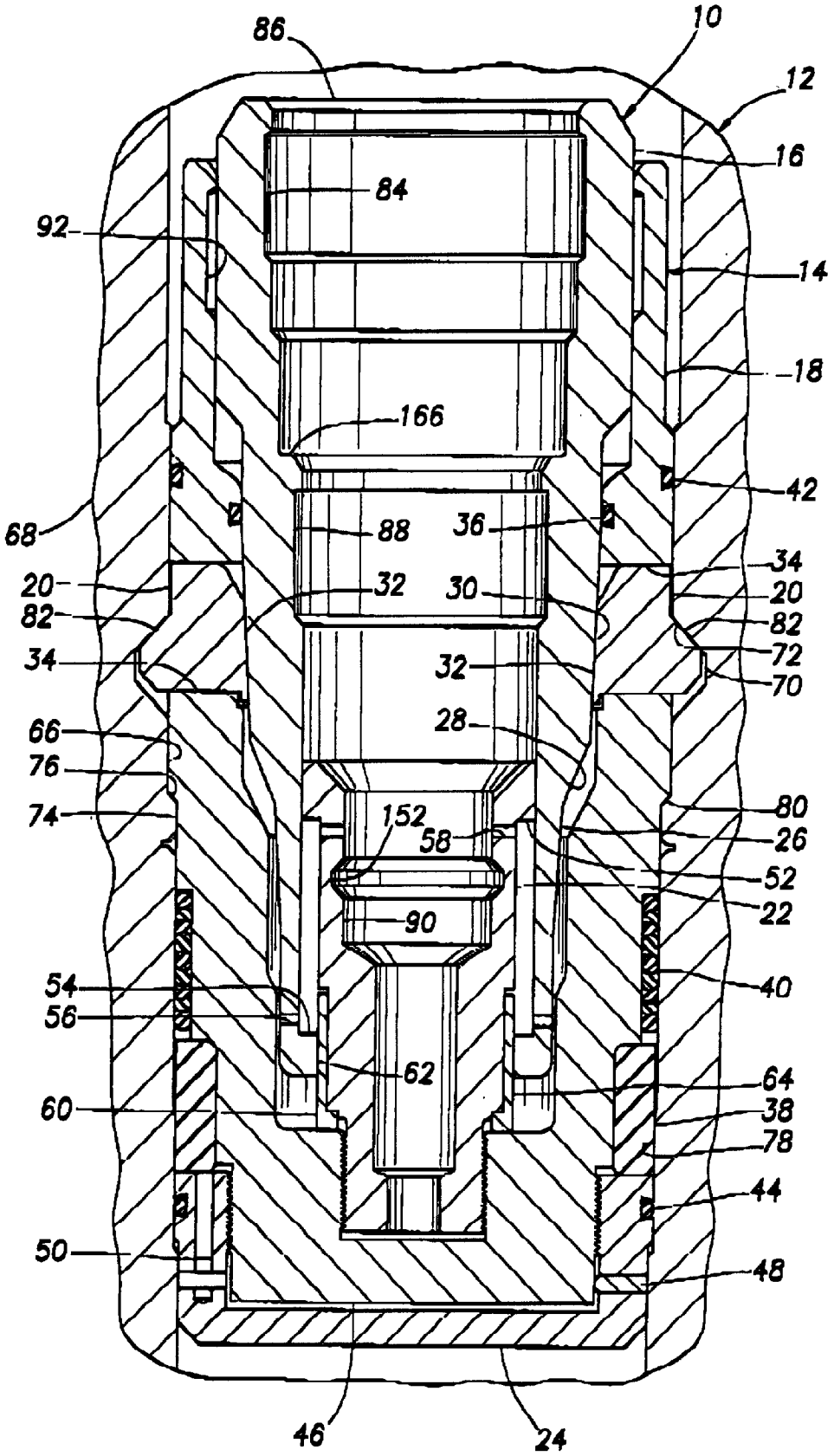
FIG. 2 is a cross-sectional view of the plug portion of FIG. 1, operatively installed within an internal profile of a tubing hanger in the wellhead.

Referring additionally now to FIG. 2, the plug portion 14 is seen to be set in the wellhead 12. Specifically, the plug portion 14 is both sealingly and structurally engaged with a profile 66 formed internally on a tubing hanger portion 68 of the wellhead 12. The profile 66 includes a radially enlarged portion 70 having an upper radially sloping surface 72, a nogo portion 74 having an internal upwardly facing angled shoulder 76, and a seal bore portion 78 below the nogo portion. According to conventional practice, the profile 66 is located in the tubing hanger 68 just above the horizontally directed production flow passage (not shown in FIG. 2).

When set in the profile 66 as shown in FIG. 2, the MTM seal 38 and packing stack 40 are sealingly received in the seal bore portion 78. The MTM seal 38 and packing stack 40, thus received, are capable of resisting fluid pressure applied from above and below the plug portion 14. However, unless it fails, the MTM seal 38 is the only seal exposed to wellbore fluids below the plug portion 14.

An external downwardly facing angled shoulder 80 formed on the outer housing 18 contacts the complementarily shaped shoulder 76 on the profile 66. Thus, the nogo portion 74 prevents further downward displacement of the plug portion 14. In this way, the nogo portion 74 is utilized to position the plug portion 14 axially within the profile 66.

The plug portion 14 is retained axially within the profile 66 by engagement of the keys 20 with the radially enlarged portion 70. As shown in FIG. 2, the keys 20 have been radially outwardly displaced by axially downward displacement of the expander sleeve 16 relative to the keys. A complementarily shaped angled upper surface 82 formed on each key 20 contacts the sloping surface 72 when the keys are sufficiently radially outwardly displaced. Thus, the plug portion 14 is "wedged" between the shoulder 76 of the nogo portion 74 and the surface 72 of the enlarged portion 70 when properly set in the profile 66. Such engagement of the keys 20 with the enlarged portion 70 prevents upward displacement of the plug portion 14 relative to the profile 66, thereby making the plug portion 14 "static" with respect to the wellhead 12, and preventing displacement of the MTM seal 38 within the seal bore portion 78.

The expander sleeve 16 is maintained in its axially downwardly displaced position shown in FIG. 2 by at least three features of the plug portion 14. First, frictional contact between the internal surfaces 32 of the keys 20 and the external surface 30 of the expander sleeve 16 resists relative displacement therebetween. Due to the unique construction of a running tool portion 94 of the plug 10 described hereinbelow, applicants have been able to utilize an angle of only three degrees from vertical on the surfaces 30, 32, thereby enhancing the frictional forces produced by forcing the expander sleeve 16 downward between the keys 20.

Second, the internal diameter 62 of the expander sleeve 16 has been forced onto the external diameter 64 of the retainer ring 60. The interference fit between these diameters 62, 64 is particularly well suited for resisting displacement of the expander sleeve 16 due to vibration, pressure and temperature cycles, etc. Even if the expander sleeve 16 were to displace slightly upward relative to the inner sleeve 22, frictional force due to the interference fit between the diameters 62, 64 resisting such displacement would not be diminished.

Third, when fluid pressure is greater below than above the plug portion 14 (as is typically the case in wellhead applications), the angled contact between surfaces 82 and 72 on the keys 20 and portion 70, respectively, acts to apply an even greater radially inwardly directed force to the keys, thereby increasing the frictional force between the keys and the expander sleeve 16. Thus, fluid pressure from below the plug portion 14 increases its resistance to being unset from within the profile 66. Additionally, gravity acts to maintain the expander sleeve 16 in its downward position as shown in FIG. 2.

Where it is desired to set an additional plug portion 14 above the plug portion shown in FIG. 2, for example, in a high pressure cap (not shown) on the wellhead 12, it will be readily appreciated that the target 24 of the upper plug portion may be positioned in close proximity to the expander sleeve 16 of the lower plug portion, so that the upper plug portion 14 will act to prevent unsetting of the lower plug portion. This is due to the fact that the expander sleeve 16 of the lower plug portion 14 must be displaced axially upward for the lower plug portion to be unset. However, it is to be understood that it is not necessary for more than one plug portion 14 to be set in the wellhead 12 or any other portion of the well for satisfactory operation of the plug portion, since the plug portion described is uniquely constructed to prevent such unsetting.

Several additional benefits of the plug 10 are apparent from consideration of FIG. 2. Note that the plug portion 14 takes up only a relatively small vertical space within the tubing hanger 68. This is due in part at least to the small distance between the upper surfaces 82 on the keys 20 and the shoulder 80 on the outer housing 18 permitted by the unique design of the plug 10. Note, also, that several locations are provided for fishing the plug portion 14 should such operations be necessary.

Specifically, an internal latch profile 84 is formed proximate an upper end 86 of the expander sleeve 16, another internal latch profile 88 is provided in the expander sleeve below the first latch profile 84, and a convenient location 90 (including an internal groove 152 described more fully hereinbelow) is provided for chemically cutting through the inner sleeve 22 and the expander sleeve. To unset the plug portion 14, the expander sleeve 16 is shifted axially upward to permit the keys 20 to radially inwardly retract. This operation would first be attempted by latching into one of the profiles 84 or 88 with a conventional fishing tool and jarring upward. If the first attempts are unsuccessful and the profile 84 or 88 becomes damaged, further attempts may be made by latching into the other one of the profiles and again jarring upward on the expander sleeve 16. If these attempts are still unsuccessful, a conventional chemical cutter may be utilized to cut radially through the inner sleeve 22 and expander sleeve 16 at location 90, thereby axially separating the inner sleeve. It should then be possible to jar upwardly on the expander sleeve 16 (at profile 84 or 88) and retrieve the expander sleeve from the wellhead. At that point, an internal latch profile 92 formed in the outer housing 18 will be exposed. By latching into the latch profile 92 and jarring upwardly, the remainder of the plug portion 14 may be retrieved from the wellhead 12.

Figure 3:
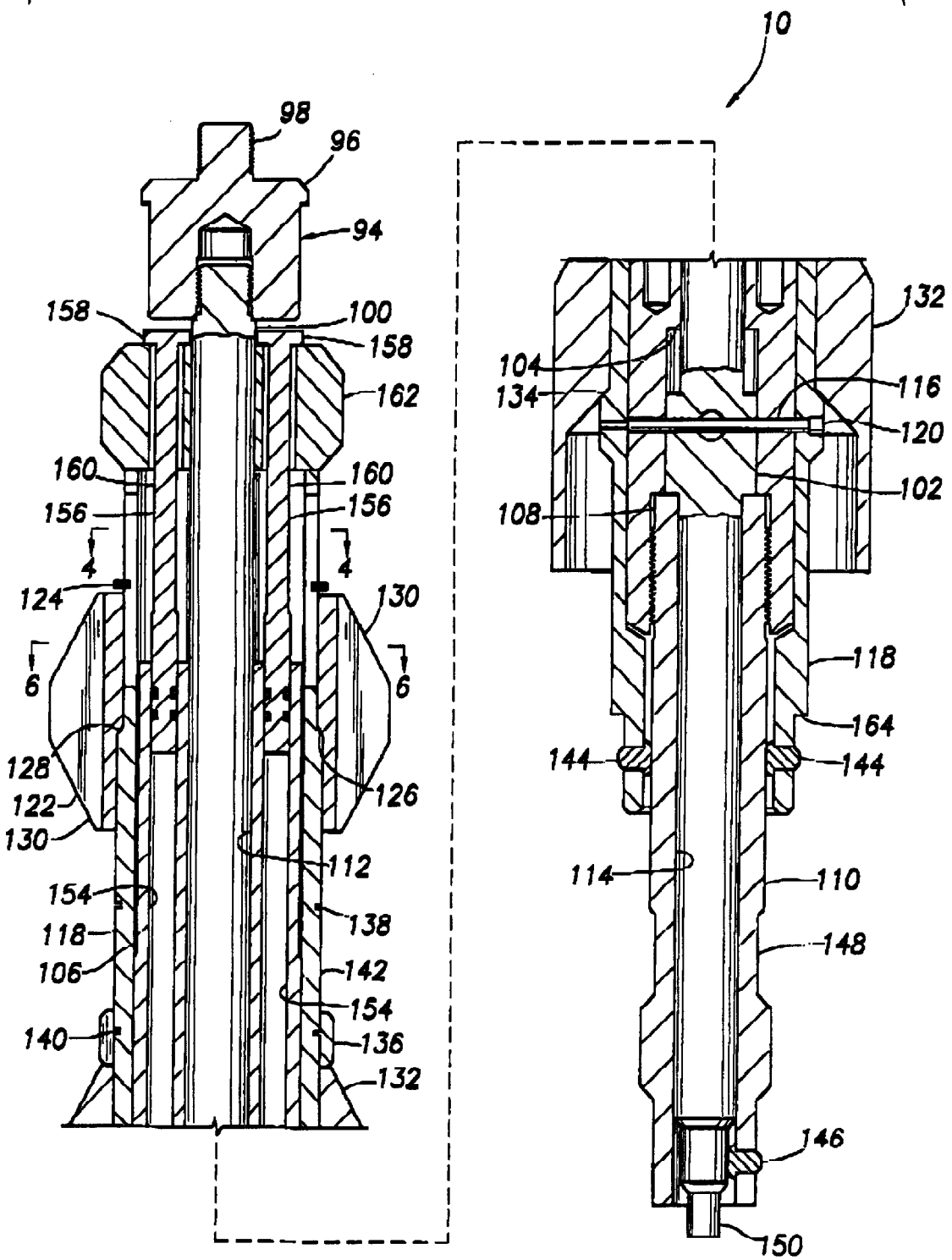
FIG. 3 is a cross-sectional view of a first running tool portion of the wellhead plug of FIG. 1, showing the first running tool in a configuration in which it is utilized to run the plug portion into the wellhead, the first running tool portion embodying principles of the present invention.

Referring additionally now to FIG. 3, a running tool portion 94 of the plug 10 is representatively illustrated. As shown in FIG. 3, the running tool 94 is configured for operative engagement with the plug portion 14 as shown in FIG. 1, for running the plug portion into the well. The running tool 94 is uniquely constructed to utilize fluid pressure to set the plug portion and includes a number of features which enhance its performance in this regard. It is to be understood, however, that other running tools may be utilized to run and set the plug portion 14, for example, another running tool is shown in FIGS. 9–12 and described hereinbelow, which also utilizes fluid pressure to set the plug portion. It is also to be understood that it is not necessary for fluid pressure to be utilized to set the plug portion 14, but that this is the method preferred by the applicants, since fluid pressure is easily and accurately controllable from the earth's surface during the setting operation and desirably produces smooth, predictable setting of the plug portion.

As shown in FIG. 3, the running tool 94 includes an upper connector 96 suitably configured for interconnection with a conventional wireline or slickline tool string (not shown). External threads 98 may be used to threadedly attach the connector 96 to tools on the tool string, such as jars, etc. It is to be understood, however, that the running tool 94 may be otherwise conveyed into the wellhead without departing from the principles of the present invention, for example, the running tool may be conveyed by coiled tubing.

At its lower end, the connector 96 is threadedly attached to a rod 100 which extends axially downward through the running tool 94. The rod 100 includes a radially enlarged portion 102 which is axially captured between a shoulder 104 formed internally on a generally tubular and axially extending piston housing 106, and an upper end 108 of a generally tubular and axially extending mandrel 110. The mandrel 110 is threadedly attached below the piston housing 106.

The rod 100 is axially slidingly received within internal bores 112, 114 formed through the piston housing 106 and mandrel 110, respectively. A shear pin 116 is installed laterally through the enlarged portion 102 of the rod 100 and the piston housing 106. The shear pin 116 prevents axial displacement of the rod 100 relative to the piston housing 106, so that the enlarged portion 102 is axially spaced apart from the shoulder 104 until the shear pin is sheared radially between the rod and the piston housing.

The shear pin 116 also extends laterally outward into a generally tubular and axially extending outer housing 118 which radially outwardly overlaps the piston housing 106. In this way, the shear pin 116 prevents relative axial displacement between the rod 100, piston housing 106, and outer housing 118, until the shear pin is sheared. Note that the shear pin 116 must only be sheared in one location to permit relative axial displacement between the outer housing 118 and the piston housing 106, but must be sheared in two locations to permit relative axial displacement between the piston housing and the rod 100. In this way, a desired succession of axial displacements may be effected by applying a corresponding succession of forces to the various components of the running tool 94 as will be more fully described hereinbelow. A small set screw 120 is threadedly installed laterally into the outer housing 118 to retain the shear pin 116.

An optional centralizer 122 is radially outwardly disposed about the outer housing 118 and is axially retained thereon by a retaining ring 124 (preferably, a conventional spiral ring) and contact between shoulders 126, 128 formed internally and externally on the centralizer 122 and outer housing 118, respectively. The centralizer 122 is representatively illustrated from a top view thereof in FIG. 4, wherein it may be clearly seen that the centralizer includes a series of circumferentially spaced apart and radially outwardly extending flutes 130. It will be readily appreciated by one of ordinary skill in the art that the number, spacing, radial extent, etc. of the flutes 130 may be easily modified as desired, for example, to conform to various dimensional restrictions of a wellhead or other passage through which the running tool 94 is conveyed. In operation, the centralizer 122 serves to assist in positioning the running tool 94 approximately centrally within the passage through which it is conveyed.

A generally tubular and axially extending outer sleeve 132 is axially slidingly and radially outwardly disposed on the outer housing 118. Axially downward displacement of the outer sleeve 132 relative to the outer housing 118 is, however, prevented by a shoulder 134 formed externally on the outer housing. As will be more fully described hereinbelow, when the running tool 94 sets the plug portion 14, the outer sleeve 132 is displaced axially upward relative to the outer housing 118. Such axially upward displacement of the outer sleeve 132 causes a corresponding upward displacement of a generally C-shaped ring 136 radially outwardly disposed about the outer housing 118 above the outer sleeve. Indicator grooves 138, 140 formed externally on the outer housing 118 are utilized upon retrieval of the running tool 94, after the plug portion 14 has been set, to determine whether the plug portion has been properly set within the profile 66.

The outer housing 118 is representatively illustrated from a side elevational view in FIG. 5, apart from the remainder of the running tool 94. In this view, it may be clearly seen that the outer housing 118 includes an externally serrated or grooved portion 142 extending axially across the indicator grooves 138, 140. The serrated portion 142 enhances frictional contact between the ring 136 and the outer housing 118, so that the ring 136 maintains its axial position until it is positively displaced by the outer sleeve 132, and after being displaced by the outer sleeve, the ring 136 maintains its axial position while the running tool 94 is retrieved from the wellhead 12. The interior of the ring 136 may also, or alternatively, be serrated, grooved, knurled, etc., as well.

The axial position of the ring 136 relative to the indicator grooves 138, 140 when the running tool 94 is retrieved provides a convenient indication of whether the plug portion 14 has been properly set. Specifically, for the illustrated preferred embodiment of the plug 10, the ring 136 should be positioned axially between the indicator grooves 138, 140 when the running tool 94 is retrieved after properly setting the plug portion 14.

The running tool 94 includes a set of upper lugs 144 extending radially outward through the outer housing 118, and a lower lug 146 extending radially outward through the mandrel 110. The upper lugs 144 are maintained in their radially outward disposed position as shown in FIG. 3 by the mandrel 110, and the lower lug 146 is maintained in its radially outward disposed position as shown in FIG. 3 by the rod 100. From a careful consideration of FIG. 3, it will become readily apparent that when the shear pin 116 is sheared radially between the outer housing 118 and the piston housing 106, the outer housing may be displaced axially downward, and the upper lugs 144 may be positioned radially opposite a radially reduced portion 148 formed on the mandrel 110, thereby permitting the upper lugs to radially inwardly retract. Similarly, when the shear pin 116 is sheared radially between the piston housing 106 and the rod 100, the mandrel 110 may be displaced axially downward, and the lower lug 146 may be positioned radially opposite a radially reduced portion 150 formed on the rod, thereby permitting the lower lug 146 to radially inwardly retract.

When operatively interconnected to the plug portion 14 for running the plug portion into the wellhead 12 (see FIG. 7), the upper lugs 144 are radially outwardly engaged with the latch profile 88 of the expander sleeve 16, and the lower lug 146 is radially outwardly engaged with a circumferential groove 152 formed internally in the inner sleeve 22. It is to be understood that various numbers, spacings, positionings, etc. of lugs 144, 146 may be utilized without departing from the principles of the present invention, for example, two or more lugs 146 may be provided, or the upper lugs 144 may be disposed to radially engage the upper latch profile 84, etc.

The piston housing 106 includes a series of axially extending and circumferentially spaced apart piston bores 154 formed internally therein. FIG. 6 representatively illustrates a top view of the piston housing 106 apart from the remainder of the running tool 94, wherein it may be clearly seen that the piston housing includes six of the piston bores 154. It is to be understood that more or less piston bores 154 may be provided in the piston housing 106 without departing from the principles of the present invention. The applicants, however, prefer to utilize six piston bores 154 because this number gives a desired degree of adjustability of the fluid pressure required to actuate the running tool 94 to set the plug portion 14. The manner in which the setting fluid pressure may be adjusted is described in greater detail hereinbelow.

Six axially disposed pistons 156 (only two of which are visible in FIG. 3) are slidingly and sealingly received in the piston bores 154, each of the pistons being received in one of the bores. Each of the pistons 156 includes a radially enlarged head 158 and an axially elongated shaft 160. Each of the shafts 160 extends axially through an abutment member 162, the abutment member being disposed axially between the piston heads 158 and the outer housing 118.

The piston bores 154 below the pistons 156 each contain air at atmospheric pressure when the running tool 94 is initially run into the wellhead 12 with the plug portion 14. The connector 96 prevents appreciable upward displacement of the pistons 156 before fluid pressure is applied to the running tool 94 in the well.

It will be readily appreciated by one of ordinary skill in the art that when fluid pressure greater than atmospheric pressure is applied to the running tool 94, the pistons 156 will be biased axially downward relative to the piston housing 106. When the pistons 156 are biased axially downward, the piston heads 158 will correspondingly apply a downwardly directed force to the abutment member 162, in turn applying the downwardly directed force to the outer housing 118. Since the outer housing 118 and piston housing 106 are axially secured relative to one another by the shear pin 116, the shear pin will resist this force until the pin shears.

With all six pistons 156 operatively installed in the piston bores 154, applicants prefer that a fluid pressure of approximately 3,000 psi is required to shear the shear pin 116 radially between the outer housing 118 and the piston housing 106, with each of the pistons having an effective piston area of approximately 0.167 square inch. The fluid pressure required to shear the shear pin 116 may be conveniently adjusted by not installing one or more of the pistons 156. For example, if one of the pistons 156 is not installed, it may be easily seen that approximately 3,600 psi will be required to shear the shear pin 116. With only four pistons 156 installed, approximately 4,500 psi will be required to shear the shear pin 116, and so forth. It is to be understood that, although the running tool 94 is described herein as having multiple pistons 156 and being adjustable in its operation by installing or not installing certain numbers of these pistons, other numbers of pistons, otherwise configured pistons, pistons having various effective piston areas, etc., may alternatively be utilized in the running tool without departing from the principles of the present invention.

Note that, as described hereinabove, when the shear pin 116 is sheared radially between the outer housing 118 and the piston housing 106, the housings are thereby released for axial displacement relative to each other. With the axially downwardly directed force being applied to the outer housing 118 by the fluid pressure acting on the pistons 160 via the abutment member 162, when the shear pin 116 shears, the outer housing will displace axially downward relative to the piston housing 106 and mandrel 110. As will be more fully described hereinbelow, such relative axial displacement of the outer housing 118 and mandrel 110 acts to set the plug portion 14. As the plug portion 14 is set, the outer housing 18 of the plug portion comes into axial contact with the outer sleeve 132 and axially upwardly displaces the outer sleeve 132 and ring 136 relative to the outer housing 118.

When the outer housing 118 has displaced axially downward sufficiently far relative to the mandrel 110, the upper lugs 144 will be disposed radially opposite the radially reduced portion or recess 148. The lugs 144 will then be permitted to radially inwardly retract, thereby permitting the outer housing 118 to be displaced axially upward relative to the plug portion 14.

After the plug portion 14 has been set within the profile 66 and the lugs 144 have been permitted to retract inward, the running tool 94 may be released from the plug portion by applying a jarring force to the upper connector 96 using conventional wireline or slickline jars. The jarring force applied must be sufficient to shear the shear pin 116 radially between the rod 100 and the piston housing 106.

When the shear pin 116 is sheared radially between the rod 100 and the piston housing 106, the rod is permitted to displace axially upward somewhat relative to the piston housing and mandrel 110, until the radially enlarged portion 102 contacts the shoulder 104. Such axially upward displacement of the rod 100 will position the radially reduced portion 150 radially opposite the lug 146, thereby permitting the lug 146 to radially inwardly retract out of engagement with the groove 152. The running tool 94 may then be axially separated from the set plug portion 14 and retrieved from the well.

Figure 7:
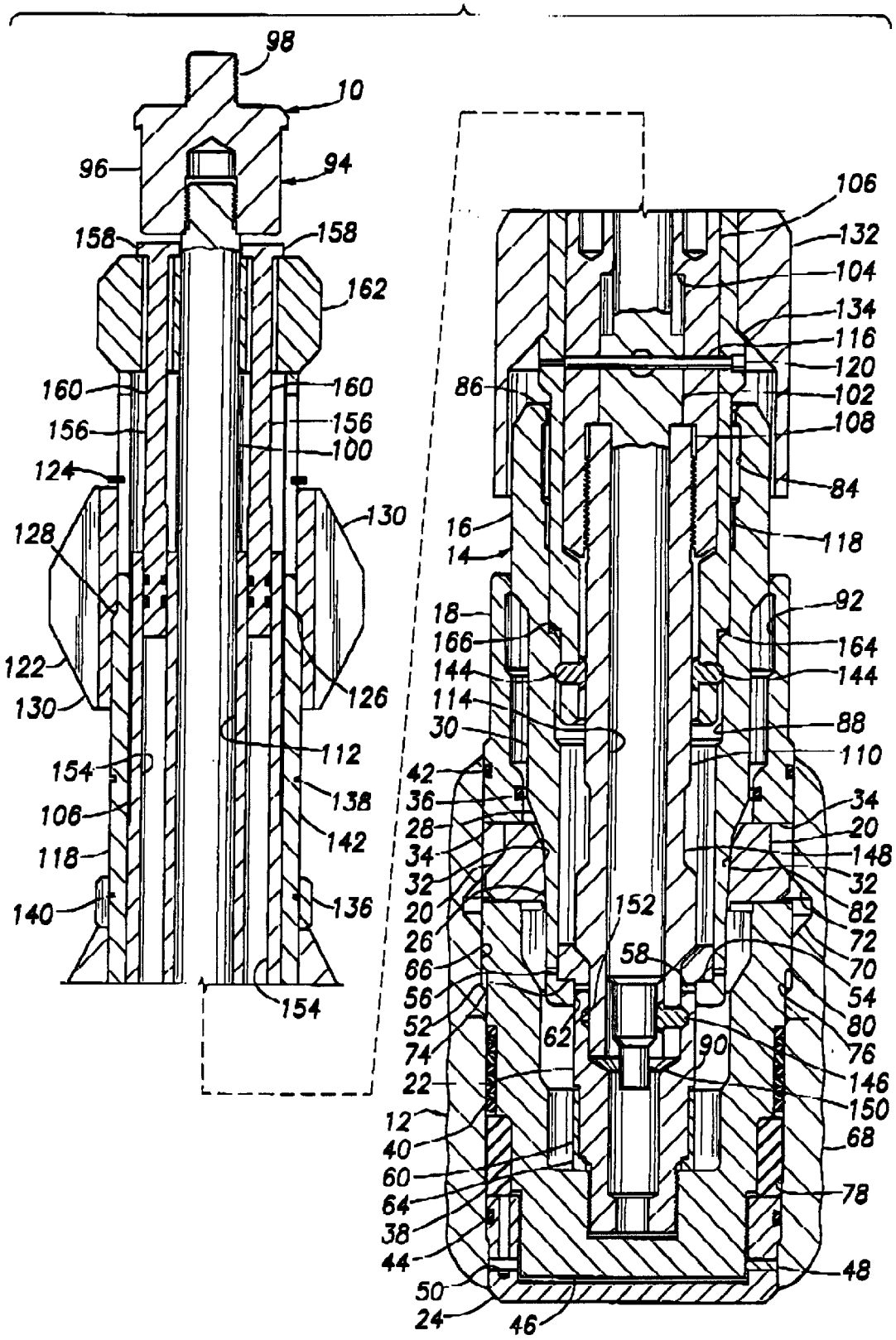
FIG. 7 is a cross-sectional view of the plug portion and the first running tool portion, showing the plug portion being run into the tubing hanger profile.
Figure 8:
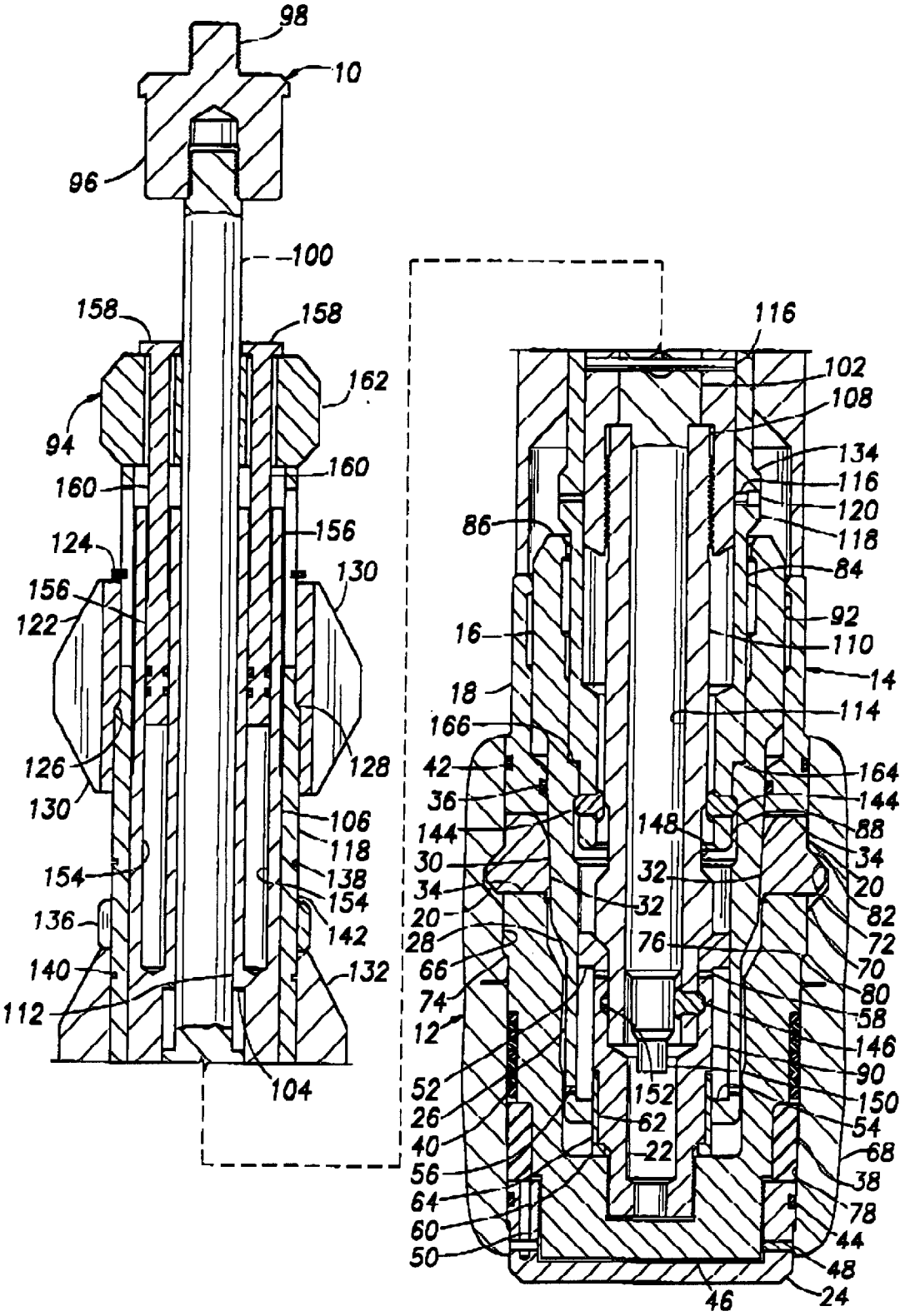
FIG. 8 is a cross-sectional view of the plug portion and the first running tool portion, showing the plug portion being set in the tubing hanger profile.

Referring additionally now to FIGS. 7 and 8, the plug 10 is representatively illustrated with the running tool 94 operatively engaged with the plug portion 14 within the wellhead 12. In FIG. 7, the plug portion 14 is being run into the tubing hanger 68 in its unset configuration, similar to that shown in FIG. 1. In FIG. 8, the plug portion 14 is being set in the profile 66.

The upper lugs 144 are radially outwardly engaged with the latch profile 88 as shown in FIG. 7, and the mandrel 110 maintains the lugs in this position while the plug portion 14 is being run into the wellhead 12. The lower lug 146 is radially outwardly engaged with the groove 152 in the inner sleeve 22.

When fluid pressure is applied to the interior of the wellhead 12, the pistons 156 bias the outer housing 118 downward as described above. When sufficient fluid pressure has been applied to shear the shear pin 116 radially between the outer housing 118 and the piston housing 106, an external shoulder 164 formed on the outer housing will contact an internal shoulder 166 formed on the expander sleeve 16, thereby transmitting the downwardly biasing force to the expander sleeve. Note that the engagement of the lower lug 146 with the groove 152 prevents axial displacement of the remainder of the plug portion 14 relative to the piston housing 106, rod 100, and mandrel 110 while the expander sleeve 18 is being downwardly biased by the outer housing 118.

FIG. 8 shows the plug 10 being set in the tubing hanger profile 66, with the expander sleeve 16 having been downwardly displaced to radially outwardly extend the keys 20 into engagement with the radially enlarged portion 70 of the profile, and to force diameter 62 on the expander sleeve over diameter 64 on the retainer ring 60. The MTM seal 38 is sealingly engaging the seal bore 78. Fluid pressure is still being applied to the running tool 94 to force the expander sleeve 18 still further downward, so that the upper lugs 144 may be retracted into the recess 148.

When sufficient fluid pressure is applied, the upper lugs 144 will be radially opposite the recess 148, the ring 136 will be axially between the indicator grooves 138, 140 (the outer housing 118 having contacted the outer sleeve 136 and displaced it axially upward), the plug portion 14 will be maintained statically in position by axial engagement of surfaces 72 and 82, and shoulders 76 and 80, and the expander sleeve 16 will be axially restrained by the interference fit between diameters 62, 64, and by frictional contact between surfaces 30 and 32. An additional benefit derived from utilization of multiple pistons 156 is that even if one of the pistons becomes stuck, leaks, or is otherwise unable to apply a downwardly biasing force to the abutment member 162, the other pistons can still set the plug portion 14. It is to be understood that the fluid pressures described herein are given by example only and that modifications within the skill of one of ordinary skill in the art are contemplated hereby, for example, the running tool 94 could be modified so that the upper lugs 144 are radially opposite the recess 148 when a fluid pressure substantially less than the pressure required to properly set the plug portion 14 is applied, and the running tool 94 could be set up so that it properly sets the plug portion 14 at a fluid pressure substantially less than the test pressure of the wellhead 12, etc.

After the plug portion 14 has been properly set by the running tool 94, an upwardly directed jarring force is applied to the rod 100 via the upper connector 96 to shear the shear pin 116 radially between the rod and the piston housing 106. When the shear pin 116 is sheared, the rod 100 may be displaced upwardly, thereby positioning the lower lug 146 radially opposite the radially reduced portion 150. The lower lug 146 will then be permitted to radially inwardly retract and the running tool 94 may be axially separated from the plug portion 14 and retrieved from the well.

Figure 9:
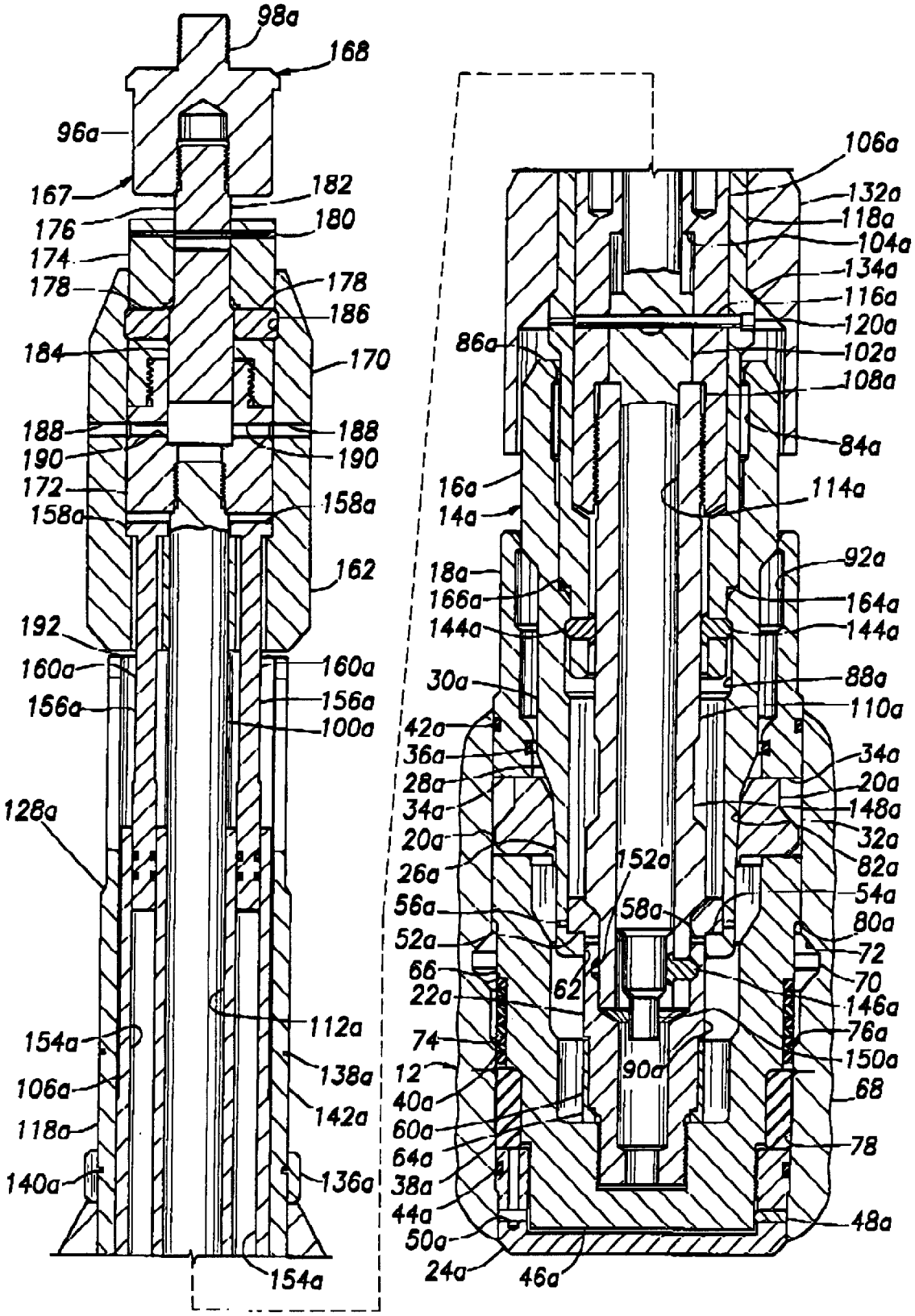
FIG. 9 is a cross-sectional view of the plug portion and a second running tool portion embodying principles of the present invention, showing the plug portion being run into the tubing hanger profile.

Referring additionally now to FIG. 9, a second running tool portion 167 is representatively illustrated as being utilized in a plug 168, which also utilizes the plug portion 14*a*. In the following description of the plug 168, elements shown in the accompanying figures which are similar to elements previously described are indicated with the same reference numerals, with an added suffix "a".

As shown in FIG. 9, the plug portion 14*a* is being conveyed into the wellhead 12 suspended from the running tool portion 167. Note that, as representatively illustrated, the running tool portion 167 does not include a centralizer, such as centralizer 122 of the running tool 94, but it is to be understood that a centralizer could be provided if desired, and could be axially retained on the outer housing 118*a* by shoulder 128*a* and a retaining ring, such as retaining ring 124 of the running tool 94.

The running tool portion 167 includes unique features which prevent inadvertent premature setting of the plug portion 14*a*. For this purpose, in place of the abutment member 162 of the running tool 94, the running tool 167 includes an actuator housing 170, a lower retainer housing 172, an upper retainer housing 174, an actuator mandrel 176, actuator keys 178, and a shear pin 180.

The actuator mandrel 176 is threadedly attached to the upper connector 96*a* in the same manner as the rod 100 is attached to the upper connector 96 in the running tool 94. The actuator mandrel 176 includes a radially reduced portion 182, through which the shear pin 180 is laterally disposed, the shear pin 180 also extending laterally through one side of the upper retainer housing 174. As shown in FIG. 9, the shear pin 180 prevents axially downward displacement of the actuator mandrel 176 relative to the upper retainer housing 174, except that the shear pin is rather loosely retained within the actuator mandrel.

The actuator mandrel 176 also includes a radially enlarged portion 184, which serves to radially outwardly retain the keys 178 in engagement with a circumferential groove 186 formed internally in the actuator housing 170. Such engagement of the keys 178 with the groove 186 prevents relative axial displacement of the upper retainer housing 174 and the actuator housing 170. When, however, the actuator mandrel 176 is axially downwardly displaced to shear the shear pin 180 and position the radially reduced portion 182 radially opposite the keys 178, as more fully described hereinbelow, the keys are thereby permitted to radially inwardly retract and permit relative axial displacement between the actuator housing 170 and the upper retainer housing 174.

The upper and lower retainer housings 174, 172, respectively, are threadedly attached to each other, and the lower retainer housing is threadedly attached to the rod 100*a*. Thus, when fluid pressure is applied within the wellhead 12, causing the pistons 156*a* to exert a downwardly biasing force on the actuator housing 170 (similar to the manner in which the pistons 156 of the running tool 94 exert a downwardly biasing force on the abutment member 162), the actuator housing 170 is not permitted to displace axially downward to contact the outer housing 118*a*, unless the keys 178 have been radially inwardly retracted out of engagement with the groove 186. Therefore, fluid pressure applied to the wellhead 12 will not result in setting of the plug portion 14*a* unless the shear pin 180 has first been sheared and the actuator mandrel 176 has been downwardly displaced to position the radially reduced portion 182 opposite the keys 178.

The actuator mandrel 176 is axially slidingly received within the upper and lower retainer housings 174, 172, respectively, with the radially enlarged portion 184 being captured therebetween. To shear the shear pin 180 prior to setting the plug portion 14*a*, a downwardly directed jarring force is applied to the upper connector 96*a* by, for example, wireline or slickline jars attached thereabove. When the shear pin 180 has been sheared, the upper connector 96*a* and actuator mandrel 176 may be downwardly displaced to position the radially reduced portion 182 radially opposite the keys 178. Otherwise, operation of the running tool 167 and setting of the plug portion 14*a* are similar to those described hereinabove for the running tool 94 and plug portion 14.

Figure 10:
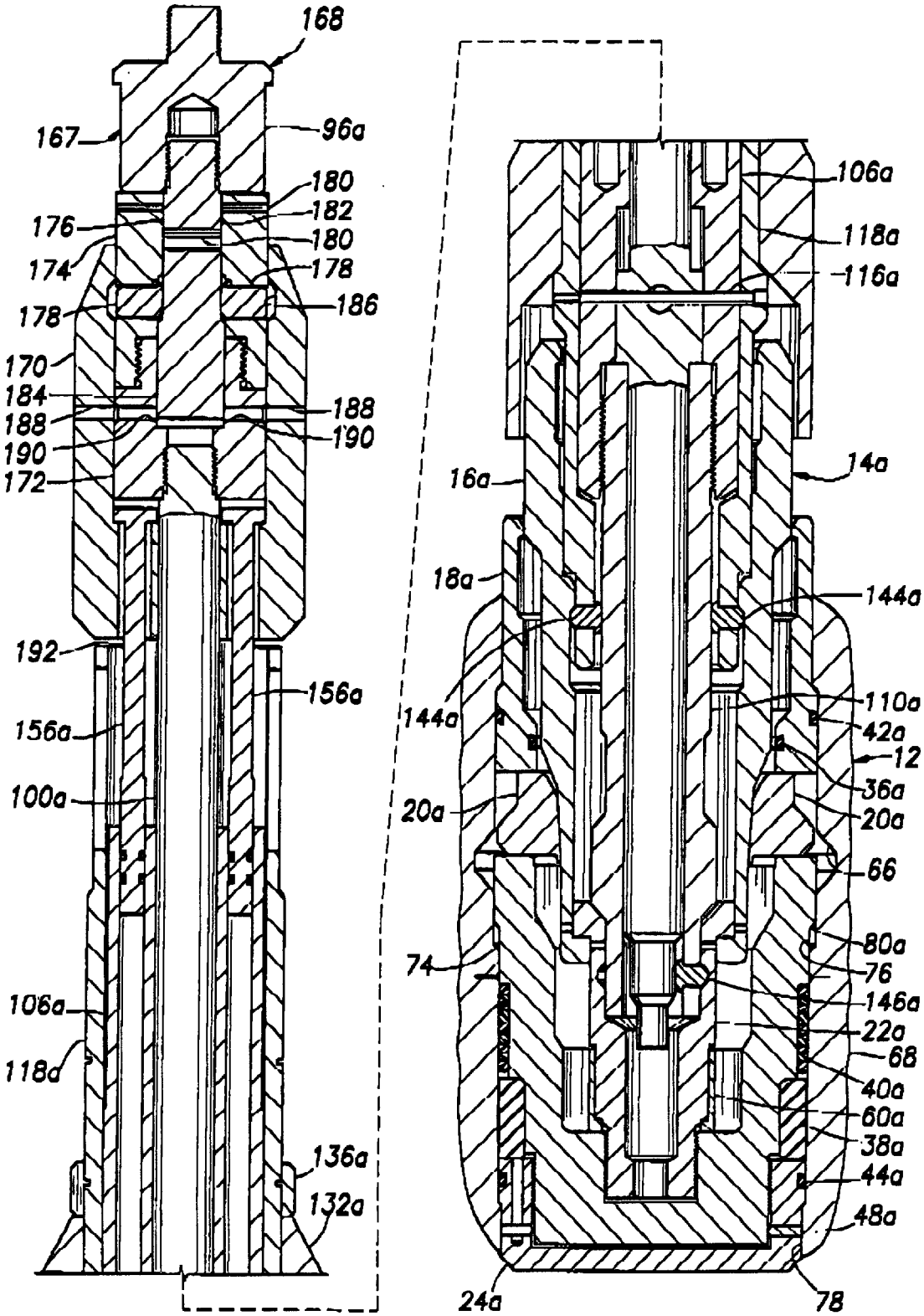
FIG. 10 is a cross-sectional view of the plug portion and the second running tool portion, showing the second running tool portion being activated for setting the plug portion.

Referring additionally now to FIG. 10, the running tool 167 is shown with the shear pin 180 sheared, the actuator mandrel 176 downwardly displaced, and the keys 178 radially inwardly retracted out of engagement with the groove 186. Ports 188, 190 formed radially through the actuator housing 170 and lower retainer housing 172, respectively, ensure that fluid is not trapped in the lower retainer housing when the actuator mandrel 176 is downwardly displaced.

Although it is preferred that the plug portion 14*a* be engaged with the nogo portion 74 of the tubing hanger profile 66, so that the plug portion is properly positioned for setting therein, FIG. 10 shows the shoulders 80*a*, 76 not yet contacting each other. FIG. 10, thus, representatively illustrates that the shear pin 180 may be sheared prematurely if desired, but it is to be understood that positive action (downward jarring on the upper connector 96*a*) must be performed before the running tool 167 will set the plug portion 14*a* in response to fluid pressure within the wellhead 12. The plug portion 14*a* will, therefore, not be prematurely set unless such premature setting is desired.

Note that an axial gap 192 exists between the actuator housing 170 and the outer housing 118*a*. This gap 192 aids in preventing a downwardly directed force from being inadvertently applied to the outer housing 118*a*, which might shear the shear pin 116*a* and permit setting of the plug portion 14*a* prematurely. Thus, at the time the shear pin 180 is sheared, no downward force is thereby transmitted to the outer housing 118*a*.

Figure 11:
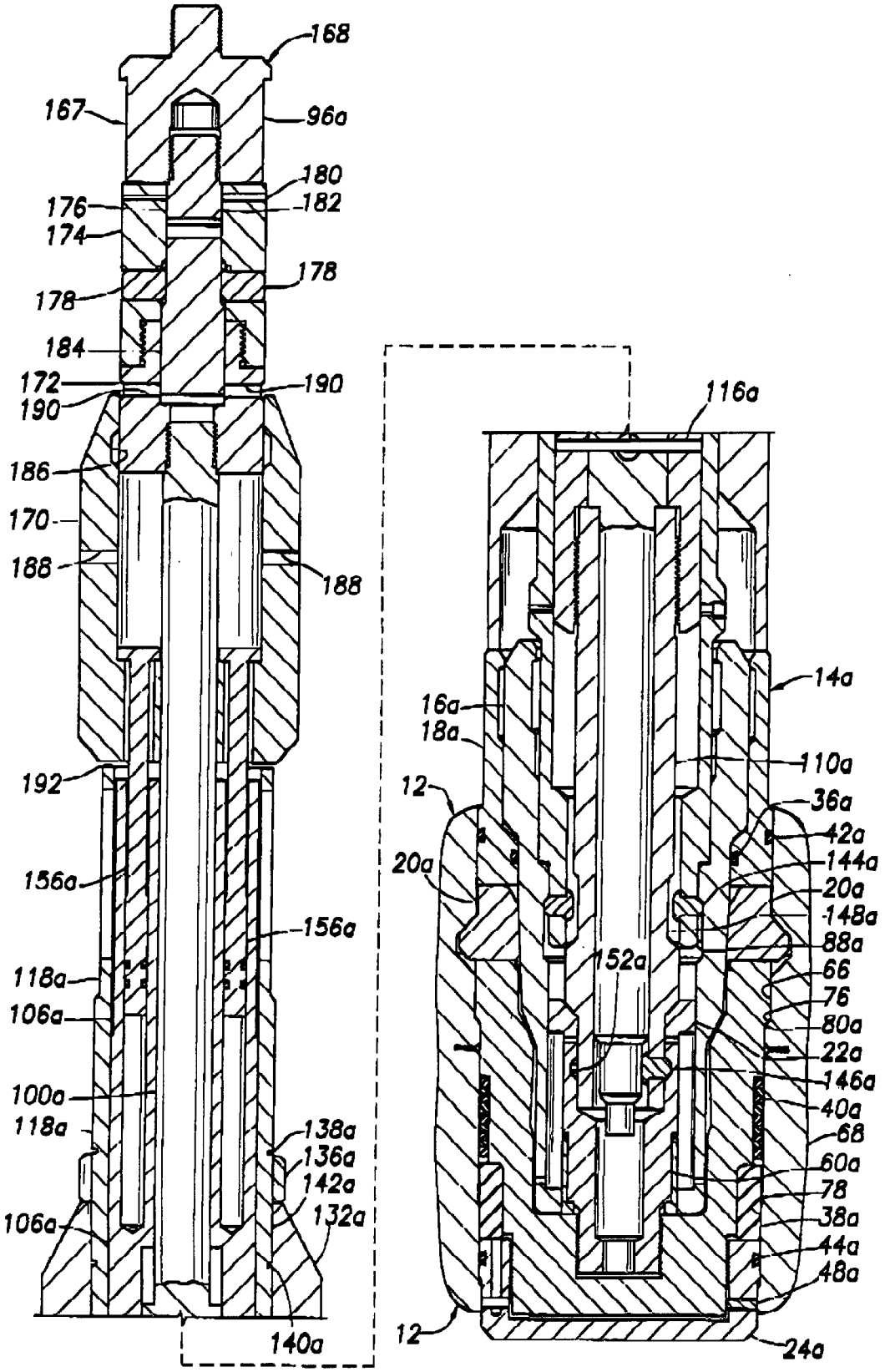
FIG. 11 is a cross-sectional view of the plug portion and the second running tool portion, showing the plug portion set in the tubing hanger profile.

Referring additionally now to FIG. 11, the plug 168 is representatively illustrated after sufficient fluid pressure has been applied to set the plug portion 14*a* within the tubing hanger profile 66. The keys 144*a* are now radially opposite the recess 148*a* and will be radially inwardly retracted out of engagement with the latch profile 88*a* when the running tool 167 is displaced upwardly to axially separate it from the plug portion 14*a*. At this point, an upwardly directed jarring force may be applied to the upper connector 96*a* to shear the shear pin 116*a* radially between the rod 100*a* and the piston housing 106*a* and thereby permit the lower lug 146*a* to radially inwardly retract out of engagement with the groove 152*a*.

Note that the ring 136*a* is axially between the indicator grooves 138*a* and 140*a*, indicating that the plug portion 14*a* has been successfully set. Note, also, that the axial gap 192 again exists between the actuator housing 170 and the outer housing 118*a*, the fluid pressure having been released, and the pistons 156*a*, therefore, no longer exerting the downwardly biasing force on the actuator housing.

Figure 12:
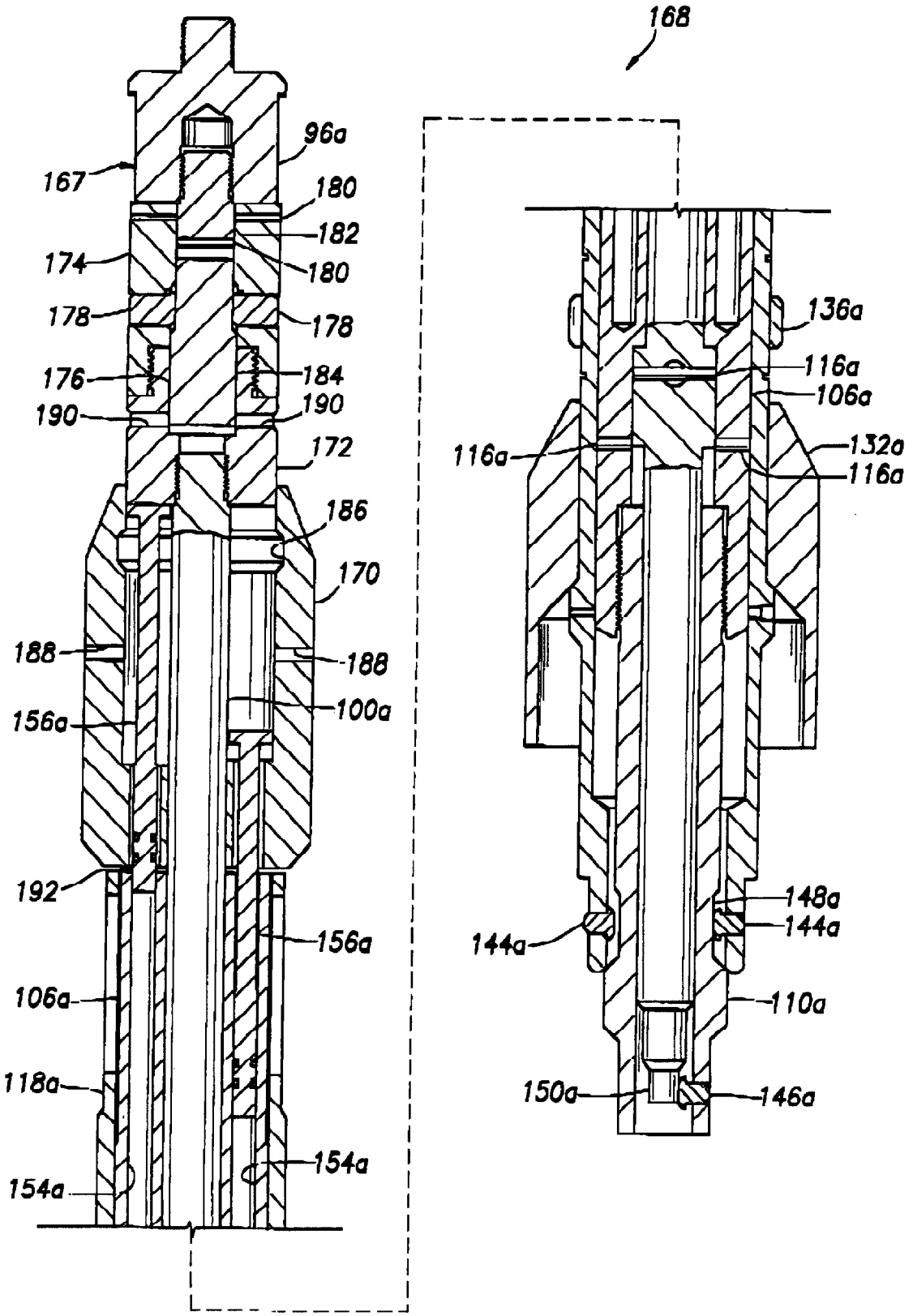
FIG. 12 is a cross-sectional view of the second running tool portion, showing the second running tool portion separated from the plug portion after the plug portion has been set.

Referring additionally now to FIG. 12, the running tool 167 is representative illustrated as it is retrieved from the wellhead 12 after properly setting the plug portion 14*a*. Each of the keys 178 and lugs 144*a*, 146*a* are radially inwardly retracted, except that FIG. 12 shows one of the upper lugs 144*a* somewhat radially outwardly extended, thereby demonstrating that the lugs and keys may be extended after the running tool 167 is axially separated from the plug portion 14*a* with no adverse effects.

Note that one of the pistons 156*a* is axially upwardly displaced so that it no longer sealingly engages its corresponding piston bore 154*a*. A unique feature of the running tools 94, 167 is that the pistons 156, 156*a* are permitted to axially upwardly displace relative to the piston housings 106, 106*a* as the running tools are retrieved. This feature permits any pressurized fluid (liquid or gas) which may have entered the piston bores 154, 154*a* while the running tools 94, 167 were disposed within the well to be released before the running tools are handled by personnel at the earth's surface, thereby enhancing safety of operations.

Thus have been described the plugs 10, 168 with their associated running tool portions 94, 167 and plug portions 14, 14*a*, respectively, which are capable of utilizing MTM seals, which are static when properly set, which are wireline-conveyable and wireline-retrievable, which are settable by application of fluid pressure, which include features which reliably maintain the plug portions in their set positions, which are relatively short in length and small in diameter, and which provide multiple locations for fishing operations. Additionally, associated methods of setting plugs within wells utilizing fluid pressure have been described. Of course, additions, modifications, and substitutions may be made to each of the steps of the methods and elements of the plugs 10, 168 described herein without departing from the principles of the present invention, for example, elongated spring-type collets may be substituted for any of the various keys 20, 20*a*, 178 and lugs 144, 144*a*, 146, 146*a* described herein, the upper connectors 96, 96*a* could be eliminated by attaching the rod 100 or actuator mandrel 176 directly to a wireline, slickline, or coiled tubing tool string, various separate elements could be combined, etc. These and other modifications are contemplated by the present invention.

Figure 13:
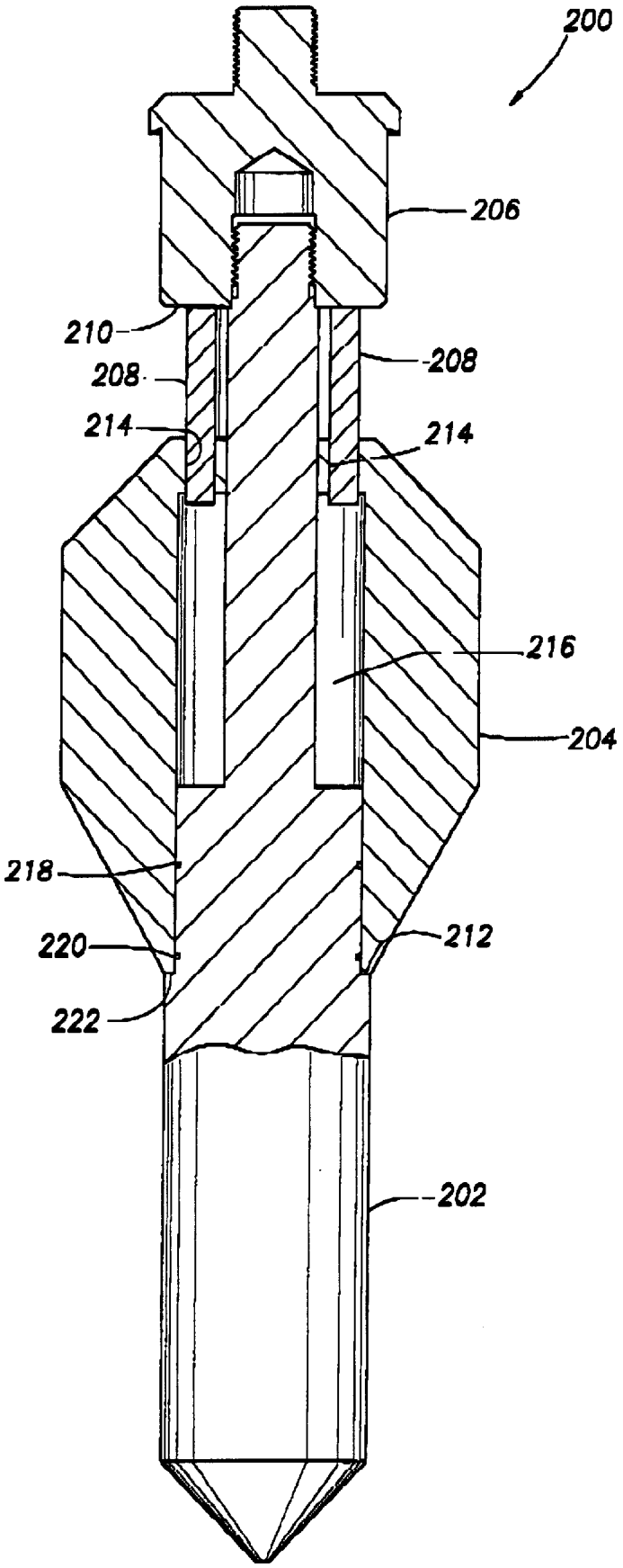
FIG. 13 is a cross-sectional view of a tool utilized in conjunction with the wellhead plug, the tool embodying principles of the present invention, and the tool being shown in its running configuration.
Figure 14:
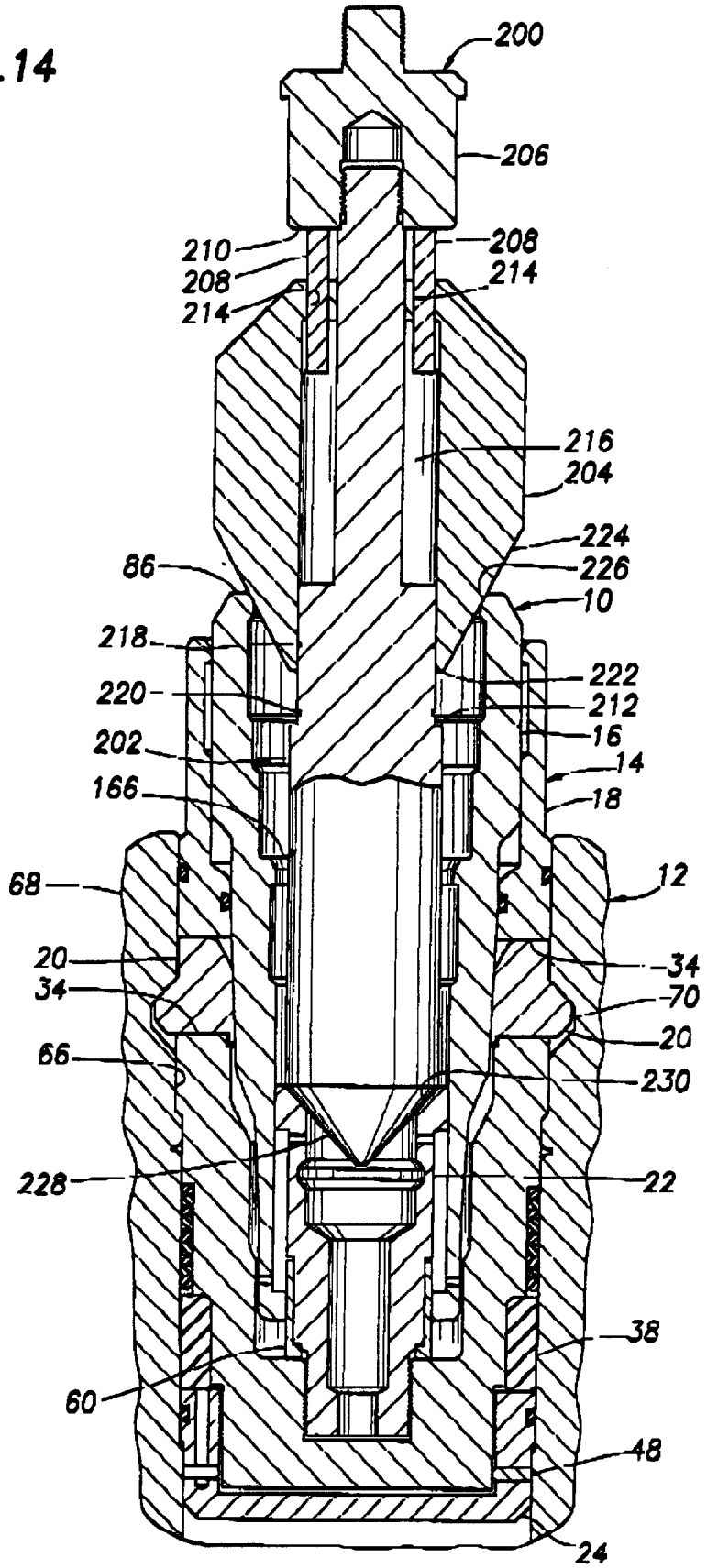
FIG. 14 is a cross-sectional view of the tool of FIG. 13 being utilized in conjunction with the plug portion.

Referring additionally now to FIGS. 13 & 14, a plug setting verification tool 200 embodying principles of the present invention is representatively illustrated. The verification tool 200 is utilized in conjunction with the plugs 10, 168 described hereinabove to verify that the plug portions 14, 14*a*, respectively, have been properly set. In the following description of the verification tool 200, its use in conjunction with the plug 10 and the corresponding plug portion 14 will be described, but it is to be understood that the verification tool may also be used with the plug 168 in a similar manner. Suitable modifications to the verification tool 200 may be made to permit its use with other plugs as well, without departing from the principles of the present invention.

The verification tool 200 is representatively illustrated in FIG. 13 in its running configuration. In operation, the verification tool 200 is run into the wellhead 12 after the running tool 94 has set the plug portion 14 in the profile 66. In this manner, the verification tool 200 is capable of verifying whether or not the plug portion 14 has been properly set.

The verification tool 200 includes an axially extending generally cylindrical inner mandrel 202, an axially extending generally tubular outer sleeve 204, an upper connector 206, which is similar to the upper connector 96 described hereinabove, and which is threadedly attached to the inner mandrel, and a series of axially extending and circumferentially spaced apart pins 208. The pins 208 and outer sleeve 204 are axially captured between a bottom surface 210 formed on the upper connector 206, and an upwardly facing shoulder 212 formed on the inner mandrel 202.

The pins 208 are installed in a series of axially extending and circumferentially spaced apart holes 214 formed through the outer sleeve 204. Each of the pins 208 is installed in one of the holes 214. Applicants prefer that four of the pins 208 be provided and that six of the holes 214 be provided, so that not all of the holes have a pin installed therein. In this manner, fluid communication is freely permitted between an annular cavity 216 formed between the outer sleeve 204 and the inner mandrel 202. It is to be understood, however, that other quantities of pins 208 and/or holes 214 may be provided without departing from the principles of the present invention.

The pins 208 are preferably of the type well known to those of ordinary skill in the art as roll pins, although they may alternatively be spiral pins or another type of pin. Some frictional contact is produced between the pins 208 and the holes 214 in which they are installed. Applicants prefer that this frictional contact be great enough that the pins 208 do not easily slide within the holes 214, for example, under the combined weight of the upper connector 206 and inner mandrel 202, but that the frictional contact permits sliding of the pins in the holes, for example, under the weight of a conventional sinker bar attached to the upper connector, or upon application of a slight jarring force to the upper connector using a conventional slickline jar. For this purpose, applicants have used 0.375 inch roll pins for the pins 208, installed in nominal 0.375 inch diameter holes 214, although otherwise dimensioned holes and pins may be utilized.

The outer sleeve 204 is slidingly disposed externally on the inner mandrel 202. For purposes that will become apparent upon consideration of the further description hereinbelow, the inner mandrel 202 has an upper circumferential groove 218 and a lower circumferential groove 220 externally formed thereon, the grooves being axially spaced apart above the shoulder 212. Note that, if the outer sleeve 204 is displaced axially upward relative to the inner mandrel 202, thereby causing the pins 208 to slide inwardly further through the holes 214 in which they are installed (due to axial contact between the pins 208 and the surface 210), a bottom end 222 of the outer sleeve will be correspondingly axially displaced relative to the grooves 218, 220.

FIG. 14 representatively illustrates the verification tool 200 operatively inserted into the plug portion 14, which has been properly set within the profile 66. The verification tool 200 may be conveyed to this position by, for example, attaching it to, and suspending it from, wireline, slickline, coiled tubing, etc., and transporting it into the wellhead 12 after the plug portion 14 has been set therein.

The verification tool 200 is axially and downwardly inserted into the plug portion 14, so that a radially sloping and downwardly facing surface 224 externally formed on the outer sleeve 204 contacts a complementarily shaped surface 226 formed on the upper end 86 of the expander sleeve 16. The outer sleeve 204 is, thus, prevented from further axially downward displacement relative to the plug portion 14.

When the outer sleeve 204 makes axial contact with the expander sleeve 16, the remainder of the verification tool 200 may continue to displace axially downward if the pins 208 slidingly displace downward through the holes 214 in which they are installed. As described hereinabove, the combined weight of the upper connector 206 and inner mandrel 202 is preferably insufficient to cause such displacement of the pins 208 relative to the holes 214. Thus, additional downwardly directed force is preferably applied to the upper connector 206 by, for example, a conventional slickline sinker bar and/or jar interconnected above the upper connector. If a jar is used, preferably only a slight jarring force is applied to the upper connector 206 thereby, in order to prevent a possibility of damage to the plug portion 14.

The inner mandrel 202, upper connector 206, and pins 208 may be downwardly displaced relative to the outer sleeve 204 after the outer sleeve has contacted the expander sleeve 16, until a radially sloping and downwardly facing surface 228 externally formed on the inner mandrel contacts a complementarily shaped surface 230 formed on the inner sleeve 22. At this point, axial contact exists between the inner mandrel 202 and inner sleeve 22, and between the outer sleeve 204 and expander sleeve 16. For this reason, and as will be readily apparent to one of ordinary skill in the art, the relative axial displacement between the outer sleeve 204 and the inner mandrel 202 may be utilized to determine whether the expander sleeve 16 was displaced axially relative to the inner sleeve 22 an appropriate distance to properly set the plug portion 14 in the profile 66.

If the expander sleeve 16 did not displace a sufficient axial distance downward relative to the inner sleeve 22 to properly radially outwardly displace the keys 20 into contact with the radially enlarged portion 70 of the profile 66, the outer sleeve 204 will displace a greater axial distance relative to the inner mandrel 202 than if the expander sleeve did properly displace relative to the inner sleeve. Thus, by measuring the axial displacement of the outer sleeve 204 relative to the inner mandrel 202, proper setting of the plug portion 14 may be conveniently verified.

After the verification tool 200 has been axially installed into the plug portion 14 as described hereinabove, the outer sleeve 204 having been axially displaced relative to the inner mandrel 202, the verification tool is retrieved to the earth's surface for inspection. With the pins 208 in axial contact with the surface 210, the axial position of the outer sleeve 204 relative to the inner mandrel 202 is examined.

If the bottom end 222 of the outer sleeve 204 is positioned axially between the upper groove 218 and the lower groove 220, the verification tool 200 indicates that the plug portion 14 has been properly set. If, however, the bottom end 222 of the outer sleeve 204 is positioned axially above the upper groove 218, the verification tool 200 indicates that the expander sleeve 16 has not been displaced axially downward relative to the inner sleeve 22 sufficiently far to properly set the plug portion 14. Additionally, if the bottom end 222 of the outer sleeve 204 is positioned axially between the lower groove 220 and the shoulder 212, the verification tool 200 indicates that a proper reading has not been obtained, since the inner mandrel 202 should displace axially relative to the outer sleeve 204 at least the axial distance between the shoulder 212 and the lower groove 220 if the verification tool has been properly operatively installed in the plug portion 14. Alternatively, instead of utilizing the grooves 218, 220, physical measurements may be made of the axial displacement of the outer sleeve 204 relative to the inner mandrel 202 and compared to a desired range of axial displacement.

Of course, various other modifications may be easily made to the verification tool 200 without departing from the principles of the present invention. For example, the outer sleeve 204 and/or inner mandrel 202 could be designed to contact the plug portion 14 at other locations (e.g., the outer sleeve could be designed to contact the internal shoulder 166 of the expander sleeve 16), the inner sleeve and inner mandrel could be otherwise configured (e.g., the inner mandrel could be externally disposed relative to the outer sleeve), etc. These and other modifications are contemplated by the principles of the present invention and are included therein.

The foregoing detailed description is to be clearly understood as being given by way of illustration and example only, the spirit and scope of the present invention being limited solely by the appended claims.

What is claimed is:

1. A plug for setting within a generally axially extending internal profile, the profile having a radially reduced nogo portion and a radially enlarged portion, the plug comprising:

a housing having an external shoulder formed thereon and a radially extending opening formed through a sidewall portion thereof, the shoulder being capable of engaging the nogo portion to axially position the housing within the profile, and the housing further having first and second opposite ends;

a circumferential seal externally disposed about the housing, the seal being capable of sealingly engaging the profile;

an expander sleeve axially slidably received at least partially within the housing, the expander sleeve having a first external surface formed thereon; and a key radially slidably disposed relative to the housing and radially outwardly disposed relative to the expander sleeve, the expander sleeve being capable of radially outwardly extending a portion of the key through the opening and into engagement with the profile radially enlarged portion when the expander sleeve is axially positioned relative to the housing so that the first external surface is radially opposite the key.

2. The plug according to claim 1, further comprising an end cap secured to the housing second opposite end, the end cap axially overlying the housing second opposite end.

3. The plug according to claim 2, wherein the end cap axially retains the circumferential seal on the housing.

4. The plug according to claim 2, wherein the end cap is capable of protecting the housing second opposite end from an abrasive fluid flow directed toward the housing second opposite end by sacrificially wearing away in preference to wearing away of the housing second opposite end.

5. The plug according to claim 1, wherein the expander sleeve further has a second external surface formed thereon, the second external surface being radially reduced relative to the first external surface, and wherein the key is capable of radially inwardly disengaging from the radially enlarged portion of the profile when the expander sleeve is axially positioned relative to the housing so that the second external surface is radially opposite the key.

6. The plug according to claim 1, further comprising a first member having a third surface formed thereon, the first member being secured relative to the housing, and wherein the expander sleeve further has a fourth surface formed thereon, the third surface being capable of interferingly engaging the fourth surface when the expander sleeve is axially positioned relative to the housing such that the first external surface is radially opposite the key.

7. The plug according to claim 6, wherein the first member is secured relative to the housing by a second member attached to the housing, the second member being capable of engaging the expander sleeve to prevent axial displacement of the expander sleeve from within the housing.

8. The plug according to claim 1, wherein the expander sleeve further has a second external surface formed thereon, the second external surface being radially reduced relative to the first external surface, wherein the key is capable of radially inwardly disengaging from the radially enlarged portion of the profile when the expander sleeve is axially positioned relative to the housing so that the second external surface is radially opposite the key, and further comprising a member attached to the housing, the member being capable of engaging the expander sleeve to prevent axial displacement of the expander sleeve from within the housing when the second external surface is radially opposite the key.

9. The plug according to claim 1, wherein the circumferential seal is a metal-to-metal seal, and further comprising a backup seal, the metal-to-metal seal being disposed axially between the backup seal and the housing second opposite end.

10. The plug according to claim 1, wherein the expander sleeve has first and second latch profiles internally formed thereon.

11. The plug according to claim 10, wherein the housing has a third latch profile internally formed thereon.

12. The plug according to claim 1, wherein the housing is capable of being statically secured within the profile when the key portion radially outwardly engages the radially enlarged portion of the profile.

13. A plug for setting within an internal profile having fist and second opposing surfaces formed thereon, the plug comprising:

a housing assembly having a first shoulder formed thereon, the first shoulder engaging the first profile surface and preventing displacement of the housing assembly in a first direction relative to the profile when the housing assembly is disposed within the profile;

an engagement member engaging the second profile surface and preventing displacement of the housing assembly in a second direction opposite to the first direction relative to the profile when the housing assembly is disposed within the profile; and an expander member biasing the engagement member into engagement with the second profile surface.

14. The plug according to claim 13, wherein the expander member contacts the engagement member via tapered complementarily shaped engagement surfaces formed on each of the expander and engagement members.

15. The plug according to claim 14, wherein the engagement surfaces are inclined approximately three degrees relative to a longitudinal axis of the housing assembly.

16. The plug according to claim 13, wherein the expander member is restricted from displacing relative to the housing assembly by an interference fit of first and second structures when the plug is set in the profile.

17. The plug according to claim 16, wherein the first structure is a first diameter formed on the expander member, and the second structure is a second diameter formed on the housing assembly.

18. The plug according to claim 13, further comprising a metal-to-metal seal carried on the housing assembly, the metal-to-metal seal sealingly engaging between the housing assembly and the profile when the plug is set in the profile.

19. The plug according to claim 13, wherein the housing assembly is prevented from displacing in any direction relative to the profile when the plug is set in the profile.

20. The plug according to claim 13, further comprising at least one seal carried above the engagement member and preventing debris from accumulating about the engagement member when the plug is set in the profile.

* * * * *